US006408668B1

(12) United States Patent
Figge et al.

(10) Patent No.: US 6,408,668 B1
(45) Date of Patent: Jun. 25, 2002

(54) BACK-UP OR INTERMEDIATE ROLLER FOR PRODUCING A FLAT ROLLED PRODUCT IN A ROLLING MILL

(75) Inventors: Dieter Figge, Essen; Wilhelm Schwerdt, Alpen; Uwe Quitmann, Willich, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/744,339

(22) PCT Filed: Jul. 12, 1999

(86) PCT No.: PCT/DE99/02176

§ 371 (c)(1),
(2), (4) Date: Feb. 16, 2001

(87) PCT Pub. No.: WO00/06315

PCT Pub. Date: Feb. 10, 2000

(30) Foreign Application Priority Data

Jul. 24, 1998 (DE) ..... 198 35 089

(51) Int. Cl.[7] ..... B21B 29/00
(52) U.S. Cl. ..... 72/241.4; 492/2
(58) Field of Search ..... 492/2; 72/241.4, 72/241.6, 247

(56) References Cited

U.S. PATENT DOCUMENTS 4,599,770 A * 7/1986 Kato et al. ..... 72/241.4
5,001,820 A * 3/1991 Yoshida et al. ..... 492/2

* cited by examiner

*Primary Examiner*—Lowell A. Larson
(74) *Attorney, Agent, or Firm*—Cohen, Pontain, Lieberman & Pavane

(57) ABSTRACT

A supporting or intermediate roll in rolling mills for rolling flat rolling stock, in particular strip material, having a cylindrical roll core and a tubular sleeve which is connected in a rotationally fixed manner to said roll core, engages coaxially around the same and between which and the roll core there are arranged hydraulically axially displaceable supporting bodies which support the roll sleeve against the roll core. In this case, the supporting bodies are formed with at least two annular pistons, which are arranged symmetrically in relation to the roll center and are sealed in relation to the roll core and the inside of the roll sleeve, and include a plurality of annular supporting bearings, which are arranged on the outer circumference of the pistons, are spaced apart from one another in the longitudinal direction of the roll and against which the inner surface of the roll sleeve can be positioned.

8 Claims, 1 Drawing Sheet

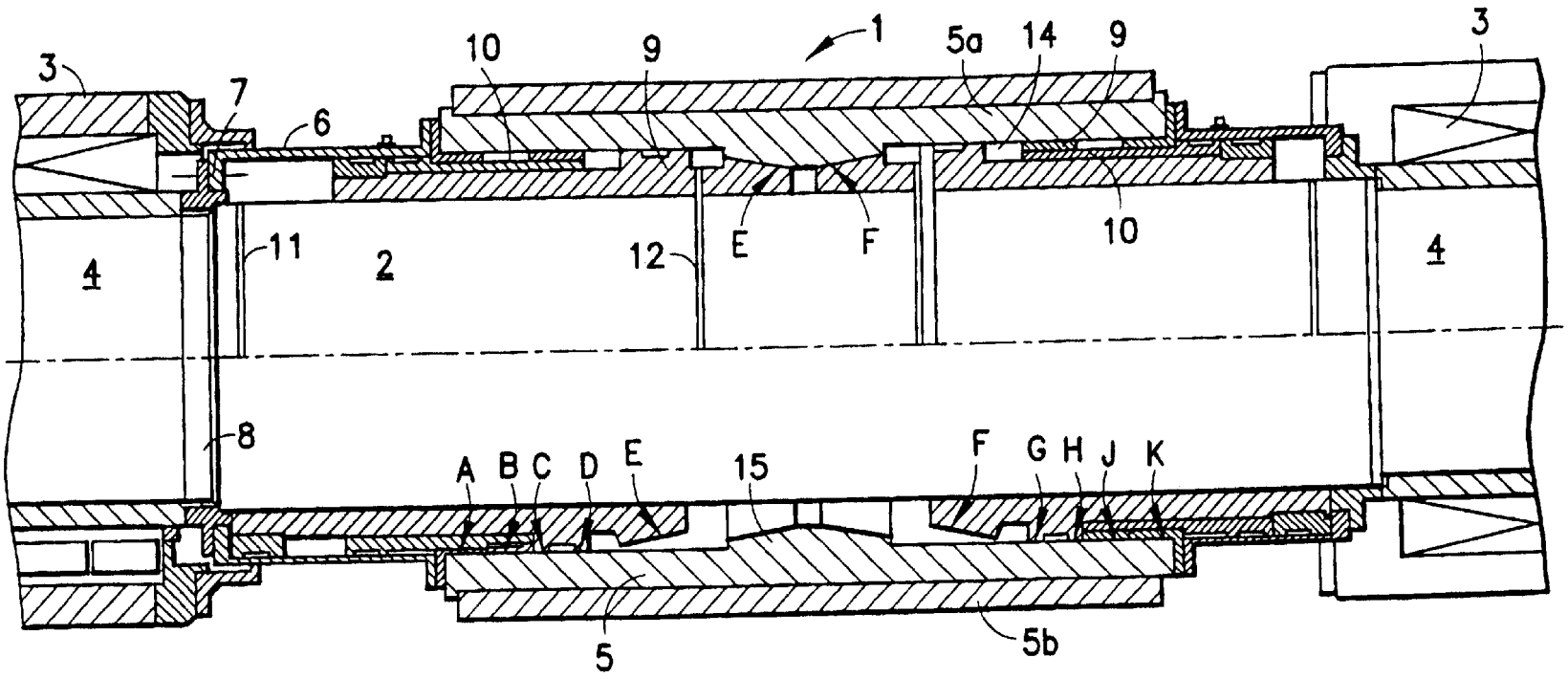
3
4
9
10
14
5a
1
F
E
9
12
10
2
6
11
7
8
4
3
K
J
H
G
F
5b
15
E
D
C
B
A
5

BACK-UP OR INTERMEDIATE ROLLER FOR PRODUCING A FLAT ROLLED PRODUCT IN A ROLLING MILL

BACKGROUND OF THE INVENTION

1. Field of the Invention

The invention relates to a supporting or intermediate roll in rolling mills for rolling flat rolling stock, in particular strip material. Such a roll comprises a cylindrical roll core and a tubular sleeve which is connected in a rotationally fixed manner to said roll core, engages coaxially around the same and between which and the roll core there are arranged hydraulically axially displaceable supporting bodies which support the roll sleeve against the roll core.

2. Discussion of the Prior Art

The profile and flatness control plays an important roll in modern hot strip mills. In this case, the negative and positive working-roll bending is the "classic" adjusting means, which allows a change in the roll gap even under load. Since, however, the conditions under which flat rolling stock is rolled are very different and width, thickness, profile and material change as well as the rolling speed and the rolling temperature, it is necessary, with the small batch sizes which are customary nowadays, to have profile- and flatness-control systems which have a large adjustment range. For this reason, in recent years, use has increasingly been made of further adjusting means in new mills, the use of ground-profile axially displaceable rolls and rolls which can be pivoted toward one another being the most well-known.

Although these known systems meet the demand of the customers of new rolling mills, who would like, in addition to the working-roll bending, at least one further adjusting means for influencing the profile, the two systems are not suitable for being adjusted under load as well.

Ground-profile rollers are also disadvantageous because, in order to achieve the desired contours, high-outlay grinding is necessary, and the geometry of this grinding also has to be very precise. Added to this is the fact that, under certain conditions, the rolling stock is deformed differently at the border and in the center; in each roll stand it is necessary to have a roll with a defined contour, which is different in each stand.

Crossing of the rolls results in the disadvantage that the crossing angle of the rolls requires particular measures for a uniform angular speed, which rules out the use of normal cross-journal universal joint shafts for driving the rolls. Moreover, the crossing produces very high axial forces, which may reach up to 10% of the radial rolling force. Added to this is the fact that the rolling-stock guidance poses problems; the rolling stock twists.

German Patent 34 14 242 has proposed a roll having the features of the generic type. In the-known sleeved roll, wedge-shaped rings are inserted between the roll core and roll sleeve, it being possible for said rings to be displaced in the longitudinal direction of the roll by pressure fluid being supplied. The wedge-shaped rings are paired with correspondingly wedge-shaped mating surfaces on the inner surface of the roll sleeve and, by virtue of a correspondingly high hydraulic pressure being applied, allow the crown of the roll to be changed and thus allow the latter to be adapted to different rolling forces and different widths of the rolling stock. The wedges with a relatively small slope, however, tend to wedge in between roll core and roll sleeve, i.e. self-locking of said wedges occurs, and this self-locking is difficult to release under rolling force. Since the wedges in the previously known solution have the function of widening the roll sleeve, it is necessary to have very high hydraulic pressures, which are to be converted into widening forces for the roll sleeve via the wedge surfaces.

SUMMARY OF THE INVENTION

The object of the present invention is, by improving a known sleeved roll, to provide an adjusting means, for profile and flatness regulation, which can be used, in particular, under rolling load, avoids the disadvantages of the prior art and makes possible, by virtue of the roll-barrel profile being changed within wide limits, adaptation to the different conditions during the rolling of flat material.

In order to achieve the object, the invention proposes to form the supporting bodies on at least two annular pistons which are arranged symmetrically in relation to the roll center and are sealed in relation to the roll core and the inside of the roll sleeve. The supporting bodies comprise a plurality of annular supporting bearings which are arranged on the outer circumference of the annular pistons, are spaced apart from one another in the longitudinal direction of the roll and against the cylindrical outer surface of which the inner surface of the roll sleeve can be positioned.

Whereas, in the known solutions, it is usual for the borders to be widened, it is possible for the proposed solution to narrow the barrel in the central region. The proposed solution is suitable for being adjusted under load because there is no widening of the roll sleeve, as with the above-described prior art. By virtue of the annular pistons, which bear the supporting bearings, being displaced axially, there is a change in the position of these pistons in relation to the length of the roll, this resulting, depending on the adjustment position and thus the supporting action of the roll sleeve, in a "hard" or a "soft" configuration of the roll. In the simplest conceivable form, the annular pistons with the supporting bearings are each moved into their axial end positions, where they can be fixed, if appropriate, by fixed stops. One end position, in which the annular pistons are positioned in the region of the roll center, produces the "hard" supported roll. The end position in which the annular pistons are positioned in the vicinity of the border region of the roll: produces the "soft" roll. The annular pistons are moved by means of pressure oil which is introduced through the roll core via rotary connections.

A further embodiment of the invention provides that the annular pistons are formed in the manner of telescopic pistons and bear axially displaceable annular pistons which can be controlled independently and on which further spaced-apart annular supporting bearings are formed. It is possible to change the spacings of the supporting bearings in relation to the supporting bearings arranged on other annular pistons, and the position of said supporting bearings in relation to the longitudinal extent of the roll, by displacement of the annular pistons.

In this way, for example with a hard-adjusted roll for a strip width of 2000 mm, the roll sleeve is supported on the roll core via ten or twelve supporting bearings which are set such that the approximately identical spacing of the supporting bearings in the center between two supports is approximately 110 mm. With corresponding dimensioning of the roll sleeve, it is possible, with a load of 4000 t, to achieve a deflection of 2 mm in the barrel center.

In the "soft" position of the same roll, a supporting distance of approximately 1350 mm is set between the supporting bearings. With corresponding dimensioning, the deflection in the barrel center of the roll, with a load of 4000 t, is approximately 6 mm. It can be seen from this example that the different deflections of the roll with the same load and different positions of the annular pistons make it possible to set at least two different crowns, it being possible for the precise regulation to take place via the working-roll bending used hitherto. Widening the invention by way of independently controllable annular pistons which can be displaced axially on the first-mentioned annular pistons allows any desired number of intermediate positions in which it is also possible to set the annular pistons, and thus the supporting bearings, non-symmetrically in relation to the roll center. For this purpose, use is made of means for regulating the quantity of oil supplied, which make it possible for the annular pistons to advance up to any desired intermediate position.

FEM tests have shown that the rolling-force distribution over the working roll, in simplified terms, corresponds to a line load, but that the supporting-force distribution over the supporting roll has a different profile. The supporting force increases from the border of the strip in the direction of the center and reaches its maximum at approximately ⅓ of the strip width. The maximum is maintained to approximately ⅔ of the strip width and then drops to zero again. The tests show that it is necessary to absorb ⅔ of the loading in the central section of the supporting roll.

In accordance with this finding, it is proposed, by way of a further feature of the invention, that at least four, preferably ten to twelve supporting bearings on at least two to four annular pistons be distributed symmetrically over the length of the rolls, the spacings between adjacent supporting bearings in the central region of the roll being selected to be smaller than the spacings which increase in the direction of the border. The spacings which are smaller in the central region of the roll on account of the higher loading thus become larger in the direction of the border, as a result of which it is possible to achieve a harmonic deflection curve for the roll.

In this way, it is possible to utilize the adjustment range to a greater extent than was possible hitherto because, according to experience, it is assumed that a large part is lost on transition to the working roll and the rolling stock. It is more or less assumed that approximately ⅓ of the crown on the supporting roll comes into contact with the rolling stock. The value of approximately 1.3 mm which can be achieved by the invention is sufficient for most cases and, in conjunction with effective roll bending, is a reasonable adjusting means, even in the case of converted roll stands.

Moreover, calculations of the deflection values of the roll according to the invention show that, in the hard position, the roll only has 0.2 mm more deflection than a solid roll. This means that even the supporting roll assembled according to the invention from core roll and sleeve has sufficiently good rigidity.

In a favorable configuration of the invention, it is proposed that, in their extended end position, the annular pistons, which are arranged symmetrically directly on both sides of the roll center, can be moved against one another on the end sides. This means that, in order to reach their -central end position, the annular pistons which are adjacent in the region of the roll center are subjected to the action of hydraulic fluid until they are positioned against one another with self-centering action.

In a particularly favorable configuration of the invention, it is provided that arranged in the roll center, on the roll core and/or on the inside of the roll sleeve, is a double-conical supporting-ring surface with a cross-sectionally roof-shaped steep-angle cone, which correspond to correspondingly conically flattened end parts of the annular pistons in the central end position of the same. This proposal makes it possible for the system to be clamped or released over a small axial distance, it not being possible, on account of the steep-angle cone of approximately 10° or more, for self-locking to occur, as may be the case with the generically determinative prior art. The conical end part of the annular piston is only used in the "hard" position, where the abutting cone surfaces support the roll sleeve in the central region and, in practice, produce a single-part roll from the "assembled" sleeved roll.

Of course, it is also conceivable in this solution, by increasing the hydraulic pressure of the annular piston, to use the cone pairing between the roll sleeve and annular piston to widen the sleeve in the center and in this way, in the hard position, to compensate somewhat for the deflection of the sleeve as a result of rolling force. The main purpose of the double-conical supporting-ring surface, however, is to support the central roll sleeve in the "hard" position of the basic annular pistons, that is to say the center of the roll.

According to a further configuration of the invention, the roll sleeve may be made up of a basic part, which engages around the annular pistons, and of an exchangeable wear part. It is conceivable here both to fasten an outer sleeve on the basic part by shrinkage or to apply removable coatings to the roll sleeve.

In a favorable configuration of the invention, the sliding surfaces in the bores are nitrated and the annular pistons are provided with bronze surfaces on the outside, in order to improve the sliding properties and to minimize the wear. For the same reason, according to a further feature of the invention, it is proposed to use lubricating oil as the hydraulic fluid because, on the one hand, the pressures which are necessary for adjusting the annular pistons are low (approximately 30 bar) in relation to the pressures which are required by the solution according to the prior art and, on the other hand, the lubricating oil used promotes the sliding properties.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The figure is a cross-section through a roll pursuant to the present invention.

DETAILED DESCRIPTION OF THE PREFERRED EMBODIMENTS.

In the single figure of the drawing, 1 designates a supporting roll according to the invention, which comprises the roll core 2, the roll journals 4, which are mounted in indicated cylinder roller bearings 3, and the roll sleeve 5, which is connected in a rotationally fixed manner to the roll core 2. The sheath. 6 ensures that the roll sleeve 5 is carried along with the roll core 2, said sheath 6 engaging at 7 in a roll-journal toothing formation indicated at 8. In the example illustrated, the supporting roll 1 is provided with a two-part roll sleeve 5, which is made up of the basic part 5*a* and the exchangeable wear part 5*b*. Of course, it is also possible for the roll sleeve to be in one piece. Between the roll sleeve, which is designated 5 hereinbelow in order to simplify matters, and the roll core 2 are the annular pistons 9, and further annular pistons 10 arranged thereon. The two pistons 9, 10 are arranged such that they can be displaced axially independently of one another, it being the case that, in the top half of the drawing, the annular pistons have been displaced such that a "hard" supporting roll is produced and, in the bottom position illustrated, the annular pistons produce a "soft" supporting roll.

The annular pistons 9 slide, by way of their bronzed surfaces, on the nitrated surfaces of the sleeve 5 and the roll core 2 and are sealed, in a manner which is not illustrated, both in relation to the roll core 2 and in relation to the inner surface of the roll sleeve 5. By virtue of a pressure medium, in the present case lubricating oil, being supplied via the rotary lead-through (not illustrated) and the supply bores 11 and 12, the annular pistons 9 can be displaced on each side of the roll center, as a result of which it is possible to change the position of the supporting bearings, which are designated overall by A to K. It is possible to change the setting of the annular pistons 10 to the same extent by subjecting them to the action of pressure oil, said pistons 10 being guided with sliding action on the annular pistons 9 and likewise being sealed in relation to the inner surface of the roll sleeve 5, with the result that it is also possible to change the position of the supporting bearings of said annular pistons 10 over the length of the supporting roll 1. The supporting roll illustrated in the exemplary embodiment has a total of 10 supporting bearings A to K, which are each formed by annular protrusions of the annular pistons 9 and 10 and have cylindrical outer surfaces which are supported against the cylindrical inside of the roll sleeve 5. The supporting bearings E and F, which are directly adjacent to the central region of the supporting roll 1, are provided with a steep-angle cone which can be positioned against a roof-shaped double cone 15 formed on the inner surface of the roll sleeve 5. In that end position of the displaced annular pistons 9 which is illustrated in the top half of the drawing, the conical end parts of the annular pistons 9 butt against the double-cone surfaces 15 and thus support the "hard" version of the supporting roll by the central region of the supporting roll 1 being supported directly against the roll core 2. In the bottom half of the drawing, the annular pistons 9 have been retracted to such an extent that the double cone 15 is freed and the supporting roll 1 may thus be deformed into the "soft" state.

What is claimed is:

1. A supporting or intermediate roll in a rolling mill for rolling flat rolling stock, comprising: a cylindrical roll core; a tubular roll sleeve connected in a rotationally fixed manner to the roll core so as to engage coaxially around the roll core; and hydraulically axially displaceable supporting bodies arranged between the roll sleeve and the roll core so as to support the roll sleeve against the roll core, the supporting bodies being formed with at least two annular pistons which are arranged symmetrically in relation to a center of the roll and are sealed in relation to the roll core on an inside of the roll sleeve, the annular pistons have a plurality of annular supporting bearings which are arranged on an outer circumference of said pistons, are spaced apart from one another in a longitudinal direction of the roll and against which an inner surface of the roll sleeve can be positioned, the annular pistons being telescopic pistons that bear further annular pistons which can be controlled independently and on which further spaced-apart annular supporting bearings are formed so that it is possible to change spacings of the supporting bearings in relation to the support bearings arranged on other annular pistons and positions of said supporting bearings in relation to the longitudinal extent of the roll, by displacement of the annular pistons.

2. A supporting or intermediate roll as defined in claim 1, wherein at least four supporting bearings are provided on at least two annular pistons and are distributed symmetrically over the length of the roll, spacings between adjacent supporting bearings in a central region of the roll being smaller than spacings which increase in a direction of end regions of the roll.

3. A supporting or intermediate roll as defined in claim 2, wherein 10–12 support bearings are provided.

4. A supporting or intermediate roll as defined in claim 1, wherein the annual pistons are arranged symmetrically directly on both sides of the roll central region and have extended end positions that are movable against one another on end sides.

5. A supporting or intermediate roll as defined in claim 1, wherein a double-conical supporting-ring surface is arranged at least one of in the roll center, on the roll core and inside of the roll sleeve, the double-conical supporting-ring surface having a cross-sectionally roof-shaped steep-angle cone which corresponds to correspondingly conically flattened end parts of the annular pistons in central end position of the annular pistons.

6. A supporting or intermediate roll as defined in claim 1, wherein the roll sleeve includes a basis part which corresponds to the annular pistons, and an exchangeable wear part.

7. A supporting or intermediate roll as defined in claim 1, wherein the sliding surfaces of bores in the sleeve are nitrated and the annular pistons are provided with outer bronze surfaces.

8. A supporting or intermediate roll as defined in claim 1, wherein the hydraulic fluid is lubricating oil.

* * * * *